United States Patent [19]

Wheatley et al.

[11] Patent Number: 4,960,144

[45] Date of Patent: Oct. 2, 1990

[54] PORTABLE BLIND

[75] Inventors: E. Durwood Wheatley; Elaine P. Wheatley, both of Wichita Falls, Tex.

[73] Assignee: Porta-Blind, Inc., Wichita Falls, Tex.

[21] Appl. No.: 371,665

[22] Filed: Jun. 23, 1989

Related U.S. Application Data

[63] Continuation of Ser. No. 123,947, Nov. 23, 1987, abandoned.

[51] Int. Cl.[5] ..... E04H 15/34

[52] U.S. Cl. ..... 135/101; 135/117; 135/112; 135/102

[58] Field of Search ..... 135/117, 101, 102, 106, 135/901, 112

[56] References Cited

U.S. PATENT DOCUMENTS

| | | | |
|---|---|---|---|
| 413,730 | 10/1889 | Palmer | 135/106 |
| 590,706 | 9/1897 | Lentz | 135/117 |
| 659,114 | 10/1900 | Voorhies | 135/101 |
| 1,522,644 | 1/1925 | Munson | 135/117 |
| 1,636,507 | 7/1927 | Goodman | 135/117 |
| 1,818,545 | 8/1931 | Eriksson | 135/DIG. 1 |
| 2,159,273 | 5/1939 | Killinger | 135/1 |
| 2,230,454 | 2/1941 | Friesner | 135/117 |
| 2,530,765 | 11/1950 | Greenup | 135/106 |
| 2,705,966 | 4/1955 | Magary | 135/106 |
| 2,783,766 | 3/1957 | Kohlbeck | 135/1 |
| 2,953,145 | 9/1960 | Moss et al. | 135/2 |
| 3,168,101 | 2/1965 | Porter | 135/105 |
| 3,223,098 | 12/1965 | Dole | 135/105 |
| 3,499,457 | 3/1970 | Waring | 135/105 |
| 3,547,136 | 12/1970 | Prinz | 135/117 |
| 3,690,334 | 9/1972 | Miller | 135/1 |
| 3,768,860 | 10/1973 | Barker | 135/117 |
| 3,913,598 | 10/1975 | Glutting, Jr. et al | 135/4 |
| 4,092,809 | 6/1978 | Bellas | 135/106 |
| 4,364,193 | 12/1982 | Visco | 43/1 |
| 4,449,542 | 5/1984 | McSwain et al. | 135/98 |

FOREIGN PATENT DOCUMENTS

| | | | |
|---|---|---|---|
| 1300282 | 6/1962 | France | 135/114 |
| 1310658 | 10/1962 | France | 135/117 |
| 2464429 | 4/1981 | France | 135/106 |
| 327552 | 1/1958 | Switzerland | 135/106 |

*Primary Examiner*—Henry E. Raduazo

*Attorney, Agent, or Firm*—Richards, Medlock & Andrews

[57] ABSTRACT

A portable blind constructed for quick assembly and disassembly without the use of tools is provided. In the preferred embodiment, the portable blind includes four frame members having three interconnected sections, a cross member, and a canopy covering the frame. The three sections of each of the frame members of the frame are attached by tension spring interconnecting mechanisms which retain the sections together when disassembled and urge the sections together in assembly. The canopy is constructed as a unit and includes closable side panel windows with built in gun supports.

19 Claims, 3 Drawing Sheets

PORTABLE BLIND

This is a continuation of application Ser. No. 123,947 filed Nov. 23, 1987 now abandoned.

TECHNICAL FIELD

This invention relates to a portable blind, and in particular a blind which may be quickly assembled and disassembled without the use of any tools.

BACKGROUND OF THE INVENTION

Blinds are concealing enclosures from which one may observe, photograph or hunt wildlife. A blind provides a hunter concealment from the sight of game animals and protection from the elements. It is desirable to have a blind which can be easily carried into the field by a hunter and readily assembled and disassembled upon reaching the desired location.

Several portable and semi-portable hunting blinds have been disclosed and patented. For example, U.S. Pat. No. 2,159,273 to Killinger ("Hunter's Blind") discloses a collapsible blind consisting of an extensive frame and two-piece cover. Similarly, U.S. Pat. No. 3,690,334 to Miller ("Portable Hunting Blind") discloses a blind consisting of an extensive frame and two-piece cover. Similarly, U.S. Pat. No. 3,690,334 to Miller ("Portable Hunting Blind") discloses a blind consisting of a cover, a four-legged frame, and a base to provide support to the frame.

A need exists for a lightweight blind that is portable by one person and is easily assembled and disassembled in the field. Such a blind should utilize a minimum number of components and be capable of assembly and disassembly without the use of any tools.

SUMMARY OF THE INVENTION

The portable blind of the present invention includes a frame and a canopy, which is preferably of single-piece construction. The frame has a cross member and at least three frame members, each frame member having a plurality of sections. The frame sections are interconnected by tension spring connecting mechanisms such that all sections are permanently attached. The portable blind is quickly and easily assembled by slidably connecting the frame sections together and slidably connecting the frame member to the cross member, lifting the frame to its upright position, and placing the unitary canopy over the frame. Similarly, the blind is readily disassembled by reversing these assembly steps.

BRIEF DESCRIPTION OF THE DRAWINGS

A more complete understanding of the present invention and its advantages will be apparent from the following Detailed Description taken in conjunction with the accompanying drawings, in which.

DETAILED DESCRIPTION

Figure 1:
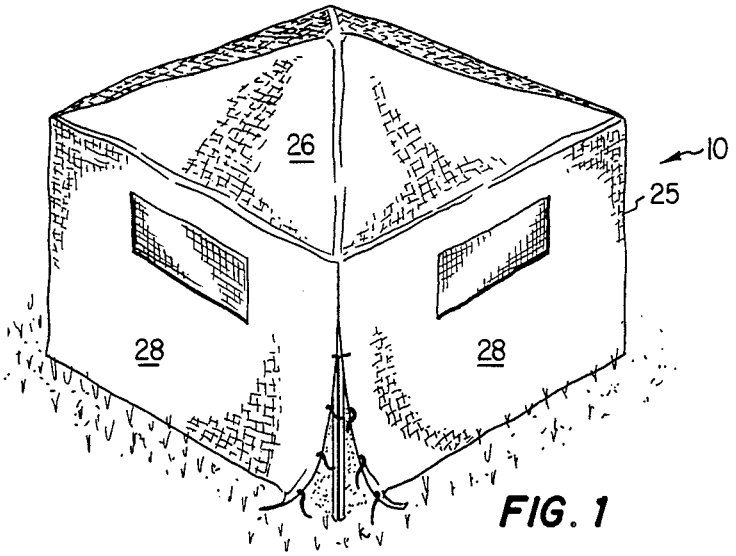
FIG. 1 is a plan view of the portable hunting blind of the present invention when erected.

A portable blind is generally indicated at 10 of FIG. 1. The blind is constructed of frame 12, generally shown in FIG. 2, and canopy 25, generally shown in FIG. 7.

Figure 2:
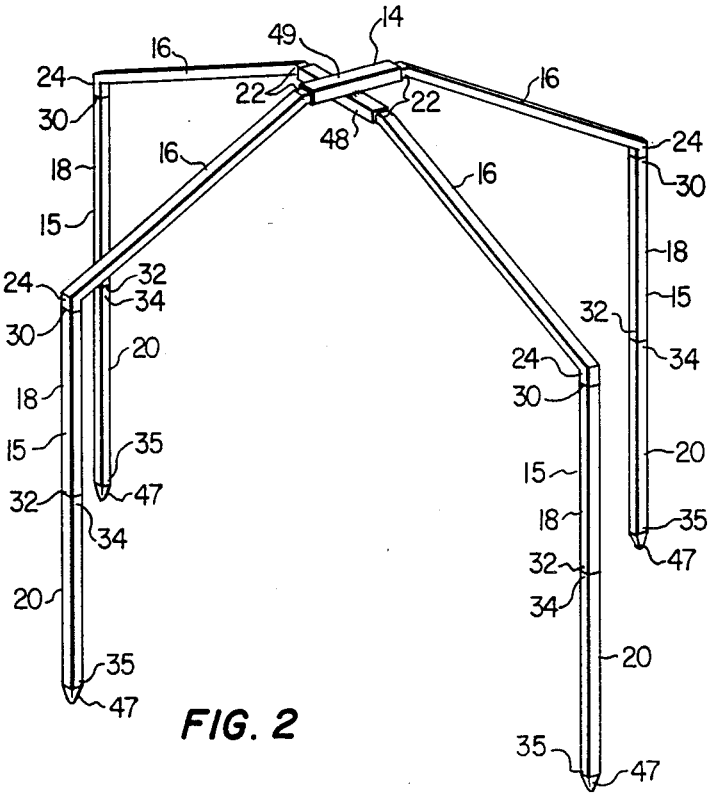
FIG. 2 is a plan view of the frame of the portable blind.

As shown in FIG. 2, the preferred embodiment of frame 12 consists of a cross member 14 and four frame members 15 each having an upper frame section 16, a middle frame section 18, and a lower frame section 20. Upper frame sections 16 include proximal portions 22 and distal portions 24. Proximal portions 22 slidably engage cross member 14, as described in greater detail below with respect to FIGS. 5 and 6. In the preferred embodiment depicted in FIG. 2, proximal portions 22 are bent downwardly such that upper frame section 16 slopes downwardly from cross member 14 to distal end 24. It is desirable that upper frame sections 16 slope downwardly in order to transfer as much force as possible onto middle frame sections 18 and lower frame sections 20, thus obviating the need for a central support post and minimizing the overall weight and complexity of frame 12. While the preferred embodiment shown in the drawings has four frame members 15 and three sections 16, 18, and 20, it should be understood that the blind 10 may be constructed of three or more frame members 15, and the frame members may consist of two or more sections. Of course, the canopy 25 could be constructed to fit any such alternate embodiment of blind 10.

Frame 12 and canopy 25 are dimensioned to provide a close fit therebetween. In particular, top panel 26 of canopy 25 is dimensioned to provide cover for blind 10 from cross member 14 to the downward bend of distal portion 24, while side panels 28 are dimensioned to provide cover from the downward bend of distal portion 24 to the distal portions of lower frame sections 20. Thus, distal ends 24 define the outer periphery of top panel 26 as well as the upper extremities of side panels 28 of canopy 25.

Figure 3:
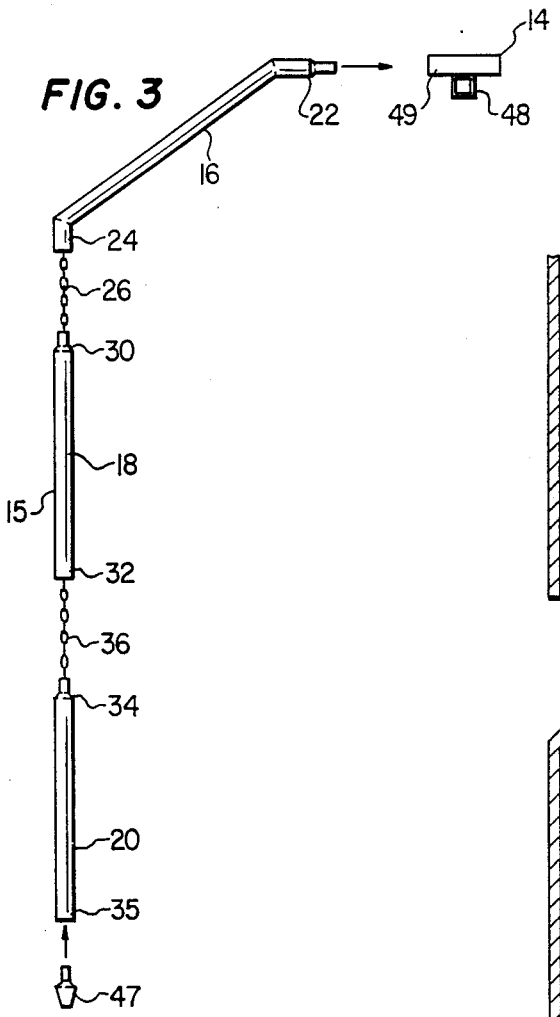
FIG. 3 is an exploded view of one leg of the frame of the portable blind.
Figure 4:
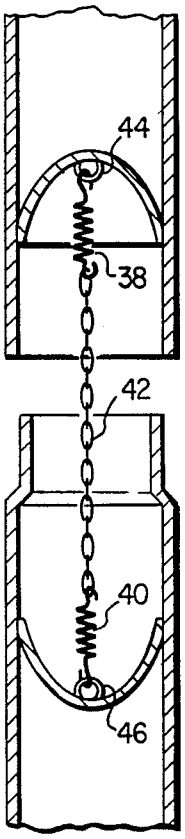
FIG. 4 is an exploded view of the tension chain interconnecting mechanism of the present invention.

As best seen in FIG. 3, distal section 24 is interconnected with proximal end 30 of middle frame section 18 by tension spring interconnecting mechanism 26. Similarly, distal end 32 of middle frame section 18 is interconnected with proximal end 34 of lower frame section 22 by tension spring interconnecting mechanism 36. Tension spring interconnecting mechanisms 26, 36, as shown in FIG. 4, comprise upper tension spring 38, lower tension spring 40, and chain 42. Upper tension spring 38 is secured to retainer 44 disposed within the hollow distal portions 24, 32 for first tension spring interconnecting mechanism 26 and second tension spring interconnecting mechanism 36, respectively. Lower tension spring 40 is secured to retainer 46 disposed within the hollow proximal portions 30, 34 for first tension spring interconnecting mechanism 26 and second tension spring interconnecting mechanism 36, respectively.

In use, tension spring interconnecting mechanisms 26, 36 urge upper frame section 16, middle frame section 18, and lower frame section 20 into engagement to form a continuous and sturdy frame 12. In a preferred embodiment depicted in FIG. 3, upper frame section 16 telescopically engages proximal section 30 of middle frame section 18 and distal section 32 of middle frame section 18, telescopically engages lower frame section 22. It is to be appreciated that first and second tension spring interconnecting mechanisms 26, 36 will cause upper frame section 16, middle frame section 18, and lower frame section 20 to telescopically engage merely by lifting frame 12 at upper frame section 16 or cross member 14. Frame 12 may then be simply and easily disassembled by manually urging apart first and second tension spring interconnecting mechanisms 26, 36. Chains 42 will continue to interconnect the sections of frame 12 to facilitate assembly of frame 12 while simultaneously permitting frame 12 to be folded for compact storage.

Feet 47 are attached to distal ends 35 of lower frame sections 20. Feet 47 are constructed to permit frame 12 to be embedded into the ground to provide support to blind 10. In the embodiment shown in FIG. 3, feet 47 are inserted into lower frame sections 20. However, it is to be appreciated that feet 47 may also be integrally formed on lower frame section 20 and still provide the requisite support to frame 12.

Figure 5:
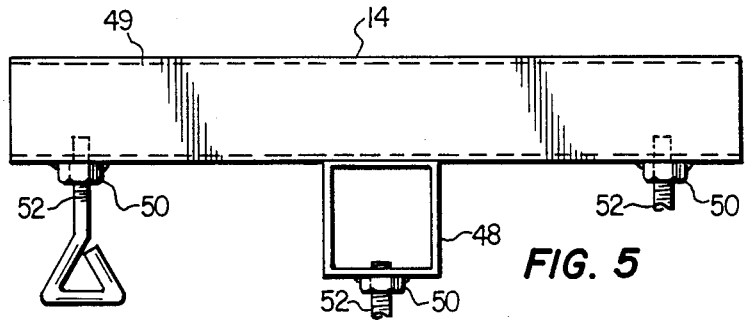
FIG. 5 is an exploded cross-sectional end view of a portion of the cross member of the present invention.
Figure 6:
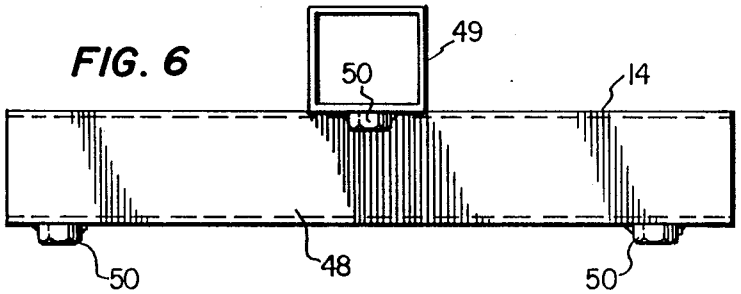
FIG. 6 is an exploded cross-sectional end view of a portion of the cross member of the present invention rotated 90 from the perspective in FIG. 5.

FIGS. 5 and 6 provide an exploded view of cross member 14. Although cross member 14 is shown as having a rectangular cross section, it should be appreciated that any cross-sectional geometry can be used provided proximal sections 22 of upper frame sections 16 are able to telescopically engage cross member 14. Cross member 14 comprises two substantially perpendicular channels 48, 49. In one possible embodiment, threaded openings 50 may be placed through channels 48, 49 as shown in FIGS. 5 and 6. Screws 52 could be used to threadably engage upper frame sections 16 after their proximal ends are telescopically connected with cross member 14. For disassembly, screws 52 are simply threadably disengaged from threaded openings 50, allowing proximal ends 22 to be slidably disconnected from cross member 14.

Figure 7:
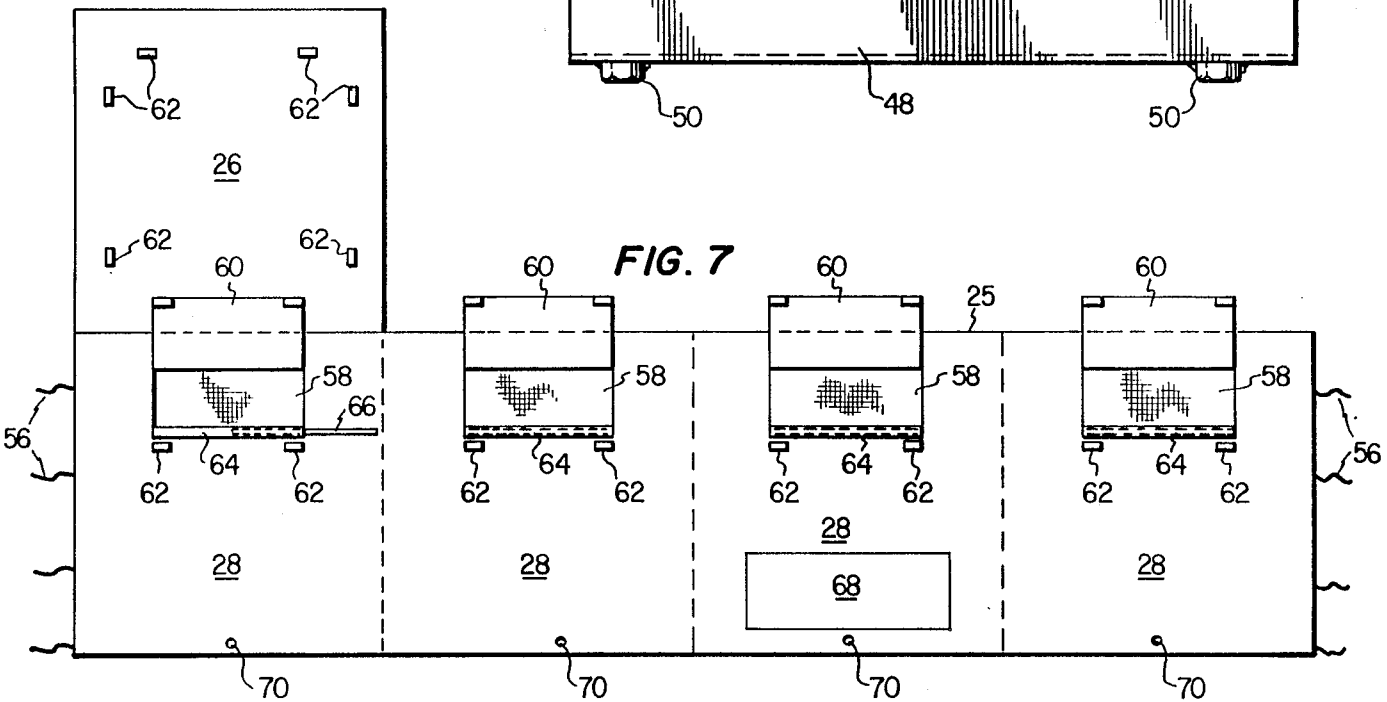
FIG. 7 is a plan view of the unitary canopy of the present invention.

FIG. 7 provides an overall plan view of the interior 54 of canopy 25. Canopy 25 comprises four side panels 28 and one top panel 26. Canopy 25 is preferably constructed of a lightweight, nylon, waterproof tent material, but it should be appreciated that a wide range of canopy materials may be used effectively. As described briefly above, side panels 28 are dimensioned to be approximately the same length as the combined length of middle frame section 18 and lower frame section 20 when they are in their erected positions, as shown in FIG. 2. Tie-strings 56 are provided on two side panels 28 to permit canopy 25 to be secured to frame 12. Although FIG. 7 shows top panel 26 as being connected to only one side panel 28, it is preferable, for stability and weatherproofing reasons, that top panel 26 be connected along all of its four sides to side panels 28. Such construction also simplifies the assembly process for the portable hunting blind 10. However, it is to be appreciated that canopy 25 can be effectively used in the configuration shown in FIG. 7 or in a configuration in which fewer than four side panels are connected to the top panel if additional securing elements 57 are provided about the upper periphery of canopy 25.

In one embodiment, window openings 58 are provided in side panels 28 in order to permit a person inside the blind 10 to see outside. Window openings 58 are preferably provided on all four side panels 28 in order to facilitate observation, photography or hunting in a 360° range. It will be appreciated that the size and position of window openings 58 can be varied to fit the intended use of portable blind 10. Window flaps 60 are provided on the interior of canopy 25 in order to minimize the intrusion of wind and rain into the blind, as well as preventing animals from seeing into the blind through a window opening 58 not in use. Window flaps 60 can be secured in either the open or closed position by fastener means 62 formed on top panel 26 and side panels 28. Fastener means 62 are preferably of the hook and loop type, such as VELCRO® manufactured by VELCRO USA, Inc.

A sleeve 64 is provided along the bottom edge of each window opening 58 and is constructed to receive a dowel 66. With dowel 66 in place in sleeve 64, the bottom edge of window openings 58 are stable enough to provide a rigid support for a rifle, allowing the hunter to keep his rifle in a ready position without the fatigue normally encountered in such a position. The dowel 66 is also capable of use as a support for a camera or binoculars.

Pocket 68 is provided on one or more side panels 28 in a preferred embodiment. Pocket 68 minimizes clutter within the blind as it is dimensioned to receive any combination of ammunition, food, thermos, etc. A plurality of eyelets 70 are preferably provided along the lower edge of side panels 28 in order to permit canopy 25 to be staked to the ground. Although blind 10 is stable without staking canopy 25, it is to be appreciated that staking provides maximum stability as well as optimal protection from the elements.

While the portable blind of the present invention has been described in detail herein, it will be evident that various and further modifications are possible without departing from the spirit and scope of the present invention.

What is claimed is:

1. A portable blind comprising:

a cross-member, said cross-member having two channel members, each said channel member having an aperture formed at its end;

four leg members, each of said leg members comprising:

an upper frame section having a proximal end and a distal end, said proximal end of said upper frame section constructed to slidably engage one of said apertures of said channel members;

a first tension spring means having a proximal end and a distal end, said proximal end of said first tension spring means disposed on said distal end of said upper frame member;

a middle frame section having a proximal end and a distal end, said distal end of said first tension spring means being disposed on said proximal end of said middle frame section, said proximal end of said middle frame section constructed to slidably engage said distal end of said upper frame member;

a second tension spring means having a proximal end and a distal end, said proximal end of said second tension spring means disposed on said distal end of said middle frame section;

a lower frame section having a proximal end and a distal end, said distal end of said second tension spring means being disposed on said proximal end of said lower frame section, said proximal end of said lower frame section constructed to slidably engage said distal end of said middle frame section; and a canopy, said canopy comprising a single piece of waterproof tent material having four side panels and one top panel, said piece of tent material arranged to substantially cover said cross-member and said leg members, one of said side panels defining a window opening therein, said side panel defining said window opening having a loop formed thereon at the lower edge of and across the width of said window opening defined in said side panel, and a reinforcement dowel having a length substantially equivalent to the width of said window opening, said dowel being dimensioned whereby said dowel can be removably disposed within said loop.

2. The portable blind of claim 1, wherein a window flap is provided for said window opening defined on said side panel, said window flap being fixably secured to said canopy.

3. The portable blind of claim 2, wherein a means for securing said window flap in a closed position is fixedly attached to said canopy.

4. The portable blind of claim 2, wherein a means for securing said window flap in an opening position is fixedly attached to said canopy.

5. The portable blind of claim 1, wherein a plurality of holes are provided at the bottom of said canopy, said holes constructed to accept stakes, whereby said canopy can be secured to the ground.

6. The portable blind of claim 1, wherein a pocket is defined on the surface of said canopy.

7. The portable blind of claim 1, wherein said distal end of said lower frame section is constructed to receive a means for embedding said leg member into the ground.

8. The portable blind of claim 1, wherein said distal end of said lower frame section is constructed to be embedded into the ground.

9. The portable blind of claim 1, wherein screw members are provided in said cross member, whereby said proximal ends of said upper frame sections may be secured within said cross member by threadably tightening said screw members.

10. The portable blind of claim 9, wherein said proximal end of said upper frame section and said cross member have substantially rectangular cross sections.

11. The portable blind of claim 1, wherein said proximal end of said- upper frame section is angled with respect to the central axis of said channel member such that said upper frame sections define a sloped roof on said blind.

12. The portable blind of claim 1, wherein said distal end of said upper frame section is angled such that said distal ends of said upper frame sections define a lower periphery of a roof on said blind.

13. The portable blind of claim 1, wherein said first tension spring means and said second tension spring means comprise a chain disposed between two tension springs.

14. The portable blind of claim 1, wherein said channel members are substantially perpendicular to one another.

15. A portable blind comprising:

a canopy, said canopy comprising a single piece of waterproof tent material having four side panels and one top panel, one of said side panels defining a window opening, said side panel defining said window opening having a loop formed thereon at the lower edge of and across the width of said window opening defined in said side panel, and a reinforcement dowel having a length substantially equivalent to the width of said window opening, said dowel being dimensioned whereby said dowel can be removably disposed within said loop.

16. The portable blind of claim 15, wherein a means for embedding said leg members into the ground is formed on each said leg member.

17. The portable blind of claim 15, wherein said leg members are constructed to receive a means for embedding said leg member into the ground.

18. The portable blind of claim 15, wherein a means for retaining said leg members is provided on said central frame member.

19. The portable blind of claim 15, wherein said tension spring means comprises a chain disposed between two tension springs.

* * * * *